US007347796B2

(12) United States Patent
Takeda

(10) Patent No.: US 7,347,796 B2
(45) Date of Patent: Mar. 25, 2008

(54) GOLF CLUB

(75) Inventor: Hitoshi Takeda, Tsubame (JP)

(73) Assignee: K.K. Endo Seisakusho, Tsubame-shi (JP)

( * ) Notice: Subject to any disclaimer, the term of this patent is extended or adjusted under 35 U.S.C. 154(b) by 212 days.

(21) Appl. No.: 11/146,158

(22) Filed: Jun. 7, 2005

(65) Prior Publication Data

US 2005/0277487 A1 Dec. 15, 2005

(30) Foreign Application Priority Data

Jun. 9, 2004 (JP) ..... 2004-171713

(51) Int. Cl.
*A63B 53/04* (2006.01)

(52) U.S. Cl. ..... 473/345; 473/349

(58) Field of Classification Search ..... 473/324–350
See application file for complete search history.

(56) References Cited

FOREIGN PATENT DOCUMENTS

| | | | |
|---|---|---|---|
| JP | 07155410 A | * | 6/1995 |
| JP | 09215786 A | * | 8/1997 |
| JP | 11057085 A | * | 3/1999 |
| JP | 11-114102 | | 4/1999 |
| JP | 2001-170225 | | 6/2001 |
| JP | 2002-17908 | | 1/2002 |
| JP | 2002-17912 | | 1/2002 |
| JP | 2002-126134 | | 5/2002 |

* cited by examiner

*Primary Examiner*—Alvin A Hunter, Jr.
(74) *Attorney, Agent, or Firm*—Westerman, Hattori, Daniels & Adrian, LLP.

(57) ABSTRACT

There is provided a golf club in which the repulsion area of a face portion is enlarged. The same face in each component of the crown portion, sole portion and the like in the body portion is welded to the face portion having a strike surface by combining metal plates having different rigidity or strength. For example, the face portion on the crown portion or the sole portion is formed of a titan alloy having high rigidity or strength, and other components are formed of pure titan. By disposing such metal plates having different rigidity or strength in one component in this manner, the repulsion area on the face portion can be enlarged, and the traveling distance obtained by hitting a ball can be increased.

6 Claims, 7 Drawing Sheets

FIG. 10

| | A | B | C | D |
|---|---|---|---|---|
| SOLE PORTION | KS120 1.15t | PURE Ti 1.2t / PURE Ti 1.2t / PURE Ti 1.2t / 15-3-3-3 1.15t | 15-3-3-3 1.15t | PURE Ti 1.2t / 15-3-3-3 1.15t / PURE Ti 1.2t / 15-3-3-3 1.15t |
| CROWN PORTION | KS120 1.0t | PURE Ti 1.0t / PURE Ti 1.0t / PURE Ti 1.0t / 15-3-3-3 1.0t | 15-3-3-3 1.0t | PURE Ti 1.0t / 15-3-3-3 1.0t / PURE Ti 1.0t / 15-3-3-3 1.0t |
| MAXIMUM RESTITUTION COEFFICIENT | 0. 865 | 0. 867 | 0. 868 | 0. 869 |
| AREA S HAVING RESTITUTION COEFFICIENT OF 0.840 OR ABOVE WITH RESPECT TO THE MAXIMUM RESTITUTION COEFFICIENT OF 0.870 | 293 mm² | 317 mm² | 291 mm² | 333 mm² |

FIG. 11

| | E | F | G |
|---|---|---|---|
| SOLE PORTION | PURE Ti 1.2t / PURE Ti 1.2t / 15-3-3-3 1.15t / PURE Ti 1.2t | PURE Ti 1.2t / 15-3-3-3 1.15t / 15-3-3-3 1.15t / PURE Ti 1.2t | PURE Ti 1.2t / 15-3-3-3 1.15t / 15-3-3-3 1.15t / PURE Ti 1.2t |
| CROWN PORTION | PURE Ti 1.0t / 15-3-3-3 1.0t / PURE Ti 1.0t / PURE Ti 1.0t | PURE Ti 1.0t / 15-3-3-3 1.0t / 15-3-3-3 1.0t / PURE Ti 1.0t | PURE Ti 1.0t / 15-3-3-3 1.0t / 15-3-3-3 1.0t / 15-3-3-3 1.0t |
| MAXIMUM RESTITUTION COEFFICIENT | 0. 870 | 0. 872 | 0. 876 |
| AREA S HAVING RESTITUTION COEFFICIENT OF 0.840 OR ABOVE WITH RESPECT TO THE MAXIMUM RESTITUTION COEFFICIENT OF 0.870 | 297 mm² | 306 mm² | 314 mm² |

GOLF CLUB

BACKGROUND OF THE INVENTION

1. Field of the Invention

The present invention relates to a golf club. More specifically, the present invention relates to a golf club with an increased high repulsion area and an increased repulsion effect.

2. Description of the Invention

Various improvements are applied to a golf club in order to increase a traveling distance or so that a stable strike can be achieved. Particularly, the traveling distance using a driver club directly influences the score, so the traveling distance is increased if scope of a striking point on its head is enlarged, which is advantageous. The striking surface of the head is called "club face", and a user usually uses a striking point called "sweet area" within the club face to strike a ball.

The striking point called "sweet area" is located adjacent to a center of gravity of the head, and is an area in which a traveling distance can be obtained most. Recently, there has been commonly used a golf club having an enlarged dimension of the driver head and thereby having an enlarged sweet area so as to realize an easy strike. Therefore, although this golf club has the advantages of resulting in less missed shots, that the struck ball does not curve, the traveling distance can be increased, and the like, the center of gravity is located at the upper side due to the enlarged dimension of the head, whereby the tendency for the sweet area to be moved to the crown side is inevitable.

For this reason, in order to obtain a traveling distance by maximizing the repulsive force that the head has, normally a ball has to be struck on the sweet area on the upper side from the center of the club face. For example, in a head (against) wind, if the ball is struck in the usual manner, the ball will have to fly against the wind, resulting in a failure to get the desired ball traveling distance, thus golfers usually strike the ball so as to produce a low ball trajectory because. In this case, the striking point is in a lower area of the club face. This, however, results in a decrease of the repulsive force and the ball traveling distance becomes less than that obtained by striking on the sweet area.

Because the center of gravity is located at the upper side of the club face, as mentioned above, that is, because the sweet area, which is a high-repulsion area, is in the vicinity of the center of gravity, if the striking point is off this area, repulsive force is reduced. Under these circumstances, various methods have been suggested to obtain a repulsive force comparable to that obtained at the conventional sweet area even at a lower point of the club face, thereby resolving the above problems. For example, as a method to increase the repulsive force, there is disclosed a golf club in which a certain area of the club face is specified and a restitution coefficient is set to minimize the decrease in ball traveling distance even at the time of offset strike (see Japanese Patent Application Laid-open No. 2002-17912, for example).

Furthermore, as a method of lowering the center of gravity and consequently increasing the repulsive force at the lower point of the club face, there is disclosed a method wherein a weight portion is provided in the lower part of the club head or the lower part is enlarged (see Japanese Patent Application Laid-open No. 2002-17908, for example). Moreover, a golf club, which has a configuration in which the club face portion is bended in a balanced manner, or other golf clubs are known (see Japanese Patent Application Laid-open No. H11-114102, for example). Also, the same applicant has been suggested a golf club in which the sole is improved so that the ball traveling distance of is not decreased even if the ball is struck at the lower part of the sweet area.

In addition, there is disclosed a technique for forming a hollow golf club head by combining a plurality of metal shells (see Japanese Patent Application Laid-open No. 2001-170225, for example), or a technique for forming a configuration in which a reinforcing member is provided as another body on the inner wall of the forward edge of the crown shell (see Japanese Patent Application Laid-open No. 2002-126134, for example). As above, techniques for producing a golf club by welding different metals are known.

As has been stated above, various methods have been devised to increase the ball traveling distance in a golf club. However, the proposed methods are still not satisfying. There is still room for improvement, particularly in terms of enlarging the sweet area. Conditions are restricted particularly in terms of producing a golf club, but it is desired to develop a golf club in which a ball traveling distance can be increased even when striking the ball in a normal fashion in such restricted conditions. In the past, some techniques were exercised, such that various modifications were applied to the body portion, or a weight portion was provided partially. However, these techniques have drawbacks in certainty, so they were not all necessarily satisfying since a slight adjustment had to be made in production of such golf clubs.

As described in the abovementioned patent applications disclosed as the prior art, the configuration for applying balanced bending on the club face portion and the crown portion is not also designed to improve a repulsion effect securely and stably in the lower part of the club face portion by enlarging the sweet area. Further, the method for providing a weight portion has some effects but also has a limit in the recent trend of enlarging the head part. In other words, there is generated a new problem that enlarging the head part by adding a weight portion will result in increasing the weight of the club head. The golf industry is a world where tradition is valued originally.

Substantial changes in the configuration, weight, etc., of the club head from those of the conventional one require users to change their golf swing and so forth, which may cause the swing rhythm to be destroyed. Even if an epoch-making golf club is developed, it will take a long time for the new golf club to become established in actual practice. Therefore, in terms of golf club appearance, it is ideal to develop a golf club which is improved in function to satisfy golfers, without substantially changing the configuration of the presently established golf clubs.

Also, the above patent applications disclose a configuration of a golf club in which the material of the head is changed. In this configuration applied in the golf club of the prior art, different type of metals, such as pure titan and a titanium alloy are applied for each part in the hosel part, or different types of metals are welded and joined as the reinforcing member. Therefore, this configuration is different from that of the present invention in which different types of metals are integrated in the same parts, so the objects of the aforementioned configuration are different from those of the present invention, and is not involved in the technique for enlarging a high repulsion area.

An ideal form of golf club does not exist in the actual situation. Therefore, it is desired to develop a golf club capable of enlarging the repulsion area and increasing the ball traveling distance stably without making substantial changes in the conventional shape.

SUMMARY OF THE INVENTION

The present invention was made in view of above-described technical background, and attains the following objects.

An object of the present invention is to provide a golf club with an enlarged high repulsion area and an increased restitution coefficient, and having a configuration in which a plurality of different types of metals are joined n the same face of the same portion.

Another object of the present invention is to provide a golf club having a configuration in which the traveling distance can be increased, even when the basic form is not different from the conventional ones.

Yet another object of the present invention is to provide a golf club which can be produced at low cost.

The present invention takes the following measures to achieve the above-described objects.

A golf club of the present invention 1 is a golf club comprising a face portion disposed at a metallic hollow golf club head and having a striking surface for striking a golf ball, and a body portion constituting a remaining part thereof, the body portion comprising a sole portion forming a lower portion of the metallic hollow golf club head, a crown portion forming an upper portion of the metallic hollow golf club head, a toe portion forming a forepart of the metallic hollow golf club head, a heel portion forming a rear part of the metallic hollow golf club head, a back portion positioned opposite the face portion and forming a back part of the metallic hollow golf club head, and a hosel portion to which a shaft is connected, wherein at least one portion of the above portions in the body portion is formed by joining a plurality of different types of metals having different rigidity or strength on the same face.

A golf club of the present invention 2 is, according to the golf club of the present invention 1, characterized in that the metals are formed into a metal plate, and the joining is performed by welding.

A golf club of the present invention 3 is, according to the golf club of the present invention 2, characterized in that the body portion is obtained by welding a sole member having one of the toe portion, the heal portion, and the back portion, a crown member having one of the toe portion, the heal portion, and the back portion, and the hosel member.

A golf club of the present invention 4 is, according to the golf club of the present invention 2, characterized in that the face portion side in the each portion of the body portion is constituted by the metal plate having high rigidity or strength.

A golf club of the present invention 5 is, according to the golf club of the present invention 2, characterized in that the back portion or a back portion side in the each portion is constituted by the metal plate having high rigidity or strength.

A golf club of the present invention 6 is, according to the golf club of the present invention 4, characterized in that, in the crown portion or the sole portion, the metal plate having different rigidity or strength is disposed within a predetermined width from the face portion to the back portion in substantially the center between the toe portion and the heal portion.

A golf club of the present invention 7 is, according to the golf club of the present invention 4, characterized in that the crown portion or the sole portion is configured such that the plurality of types of metals having different rigidity or strength are divided throughout the face portion and the back portion and the toe portion and the heal portion, and are welded to each other.

A golf club of the present invention 8 is, according to the golf club of the present invention 6 or 7, characterized in that the crown portion or the sole portion is configured such that the metal plate having high rigidity or strength is welded to the face portion and the back portion.

A golf club of the present invention 9 is, according to the golf clubs of the present inventions 1 through 8, characterized in that the metal plates having high rigidity or strength is made of a titan alloy, and other metal plates are made of pure titan.

A golf club of the present invention 10 is, according to the golf clubs of the present inventions 1 through 9, characterized in that the metal plate having different rigidity or strength is welded by combining with a metal plate having a different size of plate thickness.

BRIEF DESCRIPTION OF THE DRAWINGS

FIG. 10 shows a figure showing a strike result of an embodiment 1;

FIG. 11 is a figure showing a strike result of an embodiment 2;

DESCRIPTION OF THE PREFERRED EMBODIMENTS

As described above in detail, in the golf club of the present invention, the different types of metals are integrated and welded in the same part, the sweet area on the face portion is increased or moved downward, so the repulsive force is improved eventually, and the golf ball can be securely struck a farther distance without reducing the ball traveling distance. Moreover, since the metals have been changed from the conventional ones without changing the basic form from the conventional ones at all, when the golf club is addressed, the outer shape viewed by the player is not different from the conventional ones, and the striking performance is improved with respect to the conventional one. In production, press working, which is the same step as the conventional production method, can be applied, thus the cost is not increased, the performance can be improved, and the production can be performed in the same way as the conventional production method.

Figure 1:
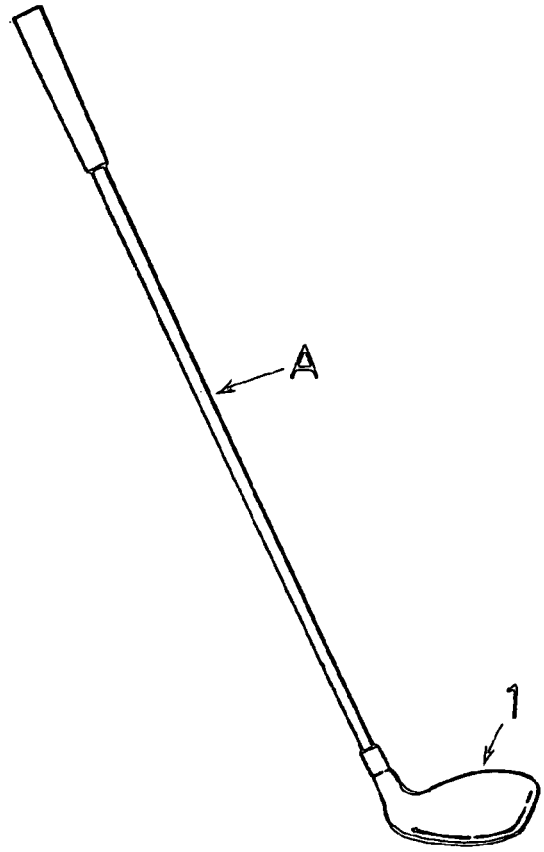
FIG. 1 is an appearance diagram showing the entire body of the golf club.
Figure 2:
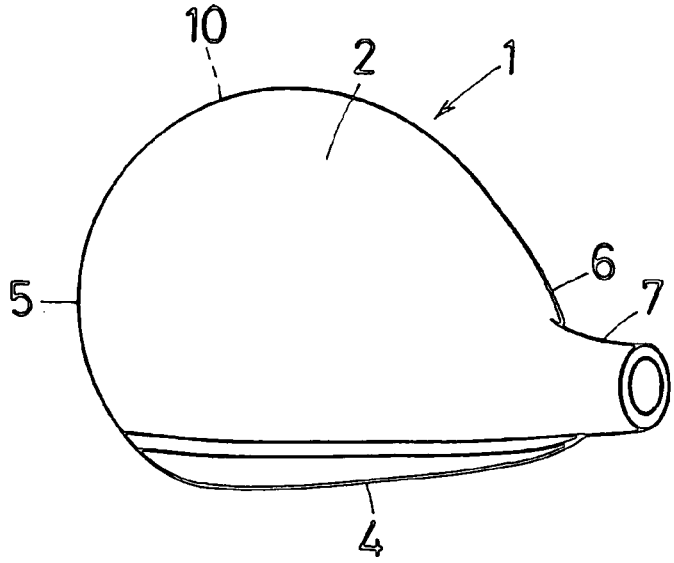
FIG. 2 is a plan view of the driver club head in accordance with the present invention.
Figure 3:
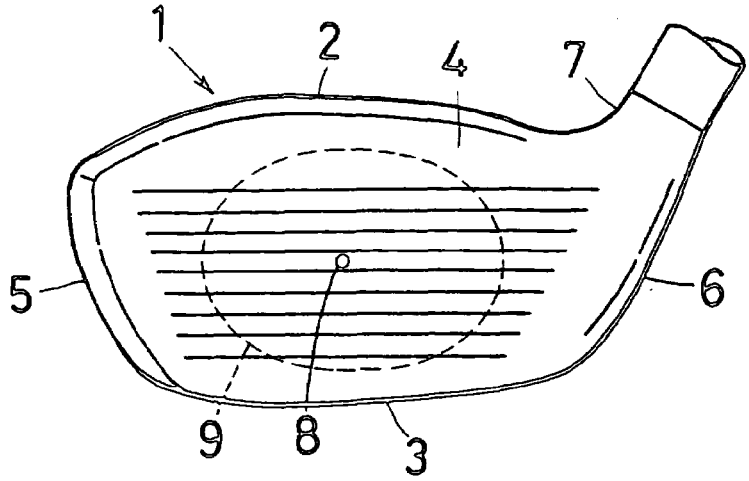
FIG. 3 is a front view of the driver club head in accordance with the present invention.
Figure 4:
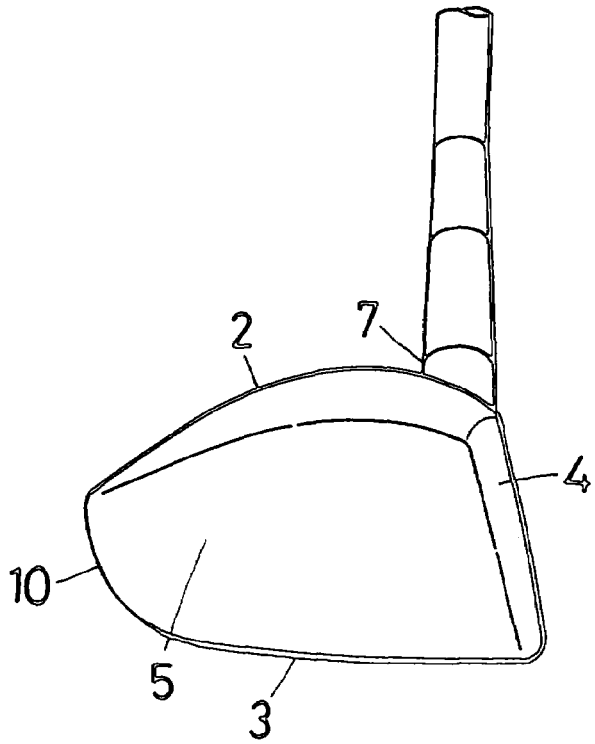
FIG. 4 is a side view of the driver club head in accordance with the present invention.

Now, embodiments of the present invention are described with reference to the drawings. FIG. 1 is an appearance diagram showing the entire body of the golf club, and shows the driver club head. The golf club of the present invention is primarily a metallic hollow golf club head. In this embodiment, the explanation will be conducted with reference to a driver club head. A driver club head 1 according to the present invention is supported on a shaft A. FIGS. 2 to 4 show an embodiment of the driver club head 1 in the metallic hollow golf club head according to eh present invention. It should be noted that the figures show only the head portion, and other members such as shaft A are omitted therein.

FIG. 2 is a plan view, FIG. 3 is a front view, and FIG. 4 is a side view. As shown in the figures, the driver club head (hereinbelow referred to simply as "head") 1 comprises a crown portion 2 corresponding to the top portion, a sole portion 3 corresponding to the bottom portion, a face portion 4 with which a golf ball is struck, a toe portion 5 corresponding to the forepart of the head 1, a heel portion 6 corresponding to the rear part of the head 1, a back portion 10 corresponding to the rear part of the head on the side opposite the face portion 4, and a hosel portion 7 which is a member for supporting the driver club head 1 on the shaft A.

In the manufacture of the head, each part comprises either a single unitized member or a plurality of parts assembled together to form one member. Each divided component part is subjected to press working and the parts are then integrated by welding or the like. In the present invention, a part of each component is, in the same component, welded with different types of metals having different rigidity or strength.

As the members in manufacturing, in the present embodiment, the golf club is composed of four parts of a face member (first member), a sole member (second member) having a part of each of the toe portion 5, heal portion 6, and back portion 10, a crown member (third member) having a part of each of the toe portion 5, heal portion 6, and back portion 10, and a hosel member (fourth member). In this case, for example, the crown member and the sole member are formed by welding a combination of a plurality of types of metals having different rigidity or strength, instead of forming them by the same metal.

A plate material is formed into a prescribed shape, heated and press shaped. The heating temperature is 400° C. for the face portion and 900° for the sole member, crown member and the like of the body member. After press processing, the components are deburred (trimmed), and then TIG welding is performed. TIG welding is also called "argon welding", in which a weld red, which is a deposit metal itself, is used to eject argon gas from the surrounding area of the tungsten electrode, and the molten metal is blocked from the atmosphere.

In the present embodiment, the material of the metal is pure titan and a titan alloy, and is used to join the face member and the sole member by butt welding them, then join the hosel member, and thereafter subject the pressed crown member to TIG welding. In this way, the component parts are integrated to configure the driver club head 1. After the welding process, the driver club head 1 is subjected to grinding, age hardening (5 hours at a temperature of 515° C.), and thereafter coating, whereby the driver club head is completed.

The face member 4 has a slight curved surface, and is configured by a plate-shaped material. The area with a maximum restitution coefficient is a sweet area 9 in the vicinity of the center of gravity 8 (area shown by the dashed line in FIG. 3). Usually, an effective way of sending a golf ball a long distance is to strike the ball at the sweet area 9. Therefore, this are is enlarged, in other words, the high repulsion area is enlarged, or the restitution coefficient is set high in this portion. It is well known that if the restitution coefficient is increased, the ball is sent a long distance. The restitution coefficient is an important factor for determining the performance of golf clubs, and a criterion of measurement has been defined by the United States Golf Association (USGA) for the restitution coefficient. The detailed explanation for the criterion is omitted.

Figure 5:
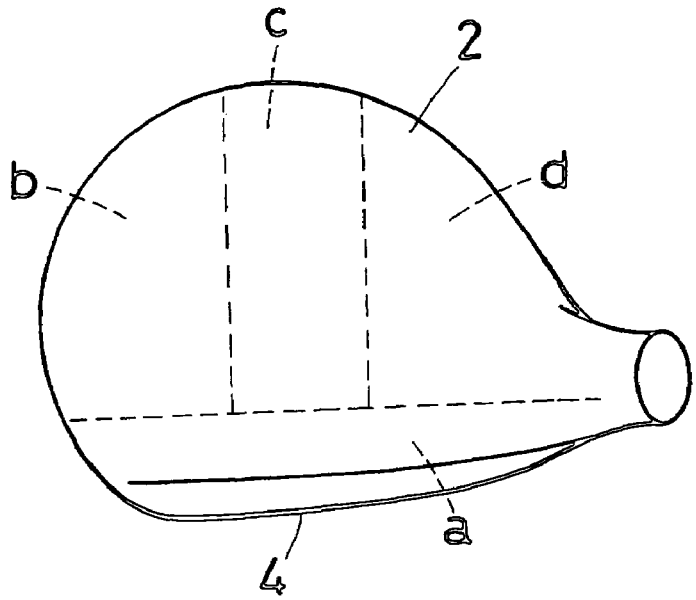
FIG. 5 is a plan view of the crown portion, which shows a configuration in which different types of metals having different rigidity or strength are integrated in a straight-line form along the face portion to the back portion, and are welded.

Next, embodiments for enlarging the high repulsion area are described. FIG. 5 shows the crown portion 2 of the driver club head 1, and configures the arrangement of the metal plate which is sectioned into four parts. In this configuration, one of the divided metal plates is disposed on the face portion side, and three other divided metal plates are welded to the metal place of the face portion 4 side and disposed in a straight-line form on the back portion side.

First of all, a portion a in the figure, is a member on the face portion side which is divided into the toe potion 5 and the heal portion 6, and the metal thereof is a titan alloy. A titan alloy used in a golf club is β titan alloy or α+β titan alloy. This is improved in its strength by heat treatment, and is excellent in workability, ductility, flexibility, strength and the like, is highly reliable, and further is excellent in rigidity and strength compared to pure titan.

In the present embodiment, a titan alloy is applied as a metal having high rigidity or strength. This titan alloy is defined in JIS. Each member b, c, and d in FIG. 5 is made of a titan alloy or pure titan. Any arrangement of this metal may be applied, or the c member may be a titan alloy, and other members may be pure titan. These three members are welded to the a member, and also welded to one another in a straight-line form along the back portion side from the face portion side. In this configuration, the face portion side in the crown portion 2 is reinforced on the member, and the back portion side is relatively weak.

Figure 6:
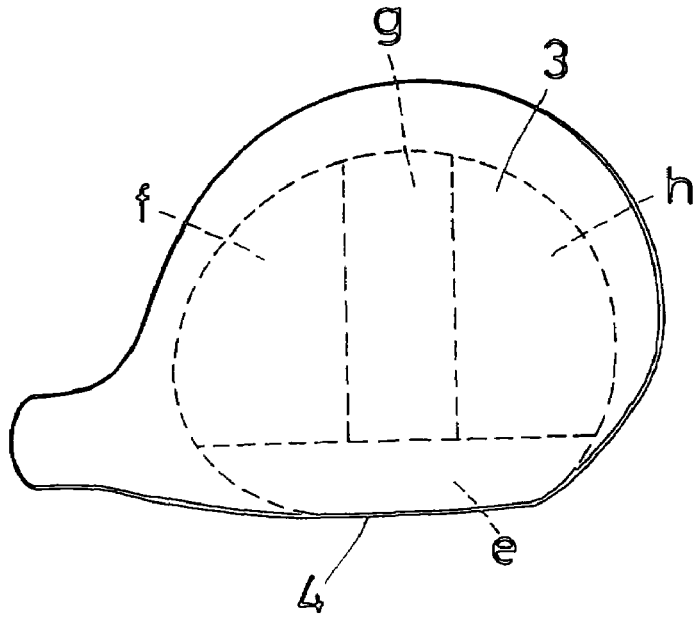
FIG. 6 is a plan view of the sole portion, which shows a configuration in which different types of metals having different rigidity or strength are integrated in a straight-line form along the face portion to the back portion, and are welded.

Therefore, as a golf club, the rigidity of the face portion is increased, and the rigidity of the back portion is relatively decreased. As a result, the rigidity of the face portion is present, and room for elastic deformation is generated on the back portion, whereby the repulsive force is increased. In the case of the present invention, the dimension of the repulsive area, which is effective in increasing the repulsive force, is enlarged. This is confirmed in the embodiment described hereinafter. The configuration in which a plurality of types of metals having different rigidity or strength are integrated in the crown portion 2 is applied in the same manner for the sole portion 5. This configuration is shown in FIG. 6. An e member on the face portion side is a titan alloy, and other members f, g, and h are a titan alloy or pure alloy.

In the present embodiment, a configuration is made such that each component in the both crown portion 2 and the sole portion 5 is provided with a plurality of metal plates having different rigidity or strength, but this configuration may b applied to either the crown portion 2 or sole portion 5. Moreover, each member of b, c and d, or each member of f, g and h may be a metal plate having different rigidity or strength, and the arrangement thereof is not limited. Further, the same metal may not be necessarily arranged in the same way for the crown portion 2 and the sole portion 5.

Figure 7:
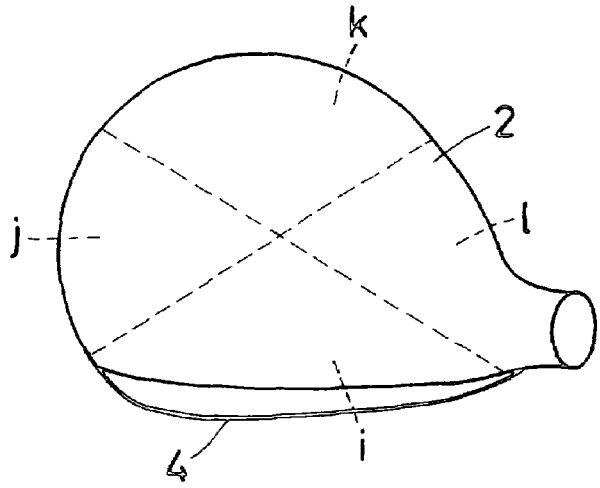
FIG. 7 is a plan view of the crown portion, which shows a configuration a configuration in which different types of metals having different rigidity or strength are integrated in a cross-line form along the face portion to the back portion, and are welded.
Figure 8:
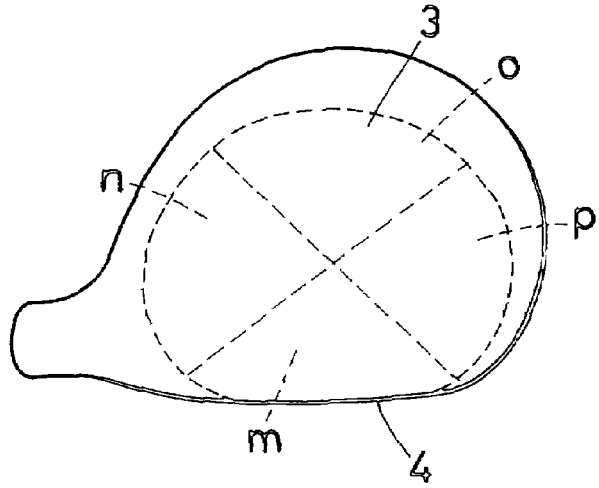
FIG. 8 is a plan view of the sole portion, which shows a configuration in which different types of metals having different rigidity or strength are integrated in a cross-line form along the face portion to the back portion, and are welded.

Next, other embodiments are explained with reference to FIG. 7 and FIG. 8. FIG. 7 shows the crown portion, and FIG. 8 shows the sole portion. They have a configuration in which a plurality of metal plates having different rigidity or strength are divided and provided in the same manner as described above. This configuration is such that the metal plates having different rigidity or strength, which are divided through out the face portion, toe portion, back portion and heal portion, with substantially the center of the crown portion 2 as the center, are welded to one another.

In the case of the present embodiment, the crown portion and the sole portion are divided in a cross-line form into the face portion, tow portion, back portion and heal portion, with substantially the center of each crown portion and sole portion as the supporting point. An i member and m member of the face portion are formed of a titan alloy, and other members j, k, and l, n, o, and p are formed of pure titan. However, this configuration is not limited. Basically, the i member and m member of the face portion may be formed of a titan alloy, and other members j, k, and l, n, o, and p are formed by combining a titan alloy and pure titan. For example, the k member and o member may be formed of a titan alloy.

In this manner, in the configuration of the present invention, a metal plate having high rigidity or strength is disposed on the back portion side, and, in the adjacent toe portion 5 and heal portion 6, a metal plate having a high rigidity or strength, i.e. a titan alloy, is disposed in a part located on the face portion side or back portion side. However, it goes without saying that the configuration is not limited to the embodiments shown in the figures.

Figure 9:
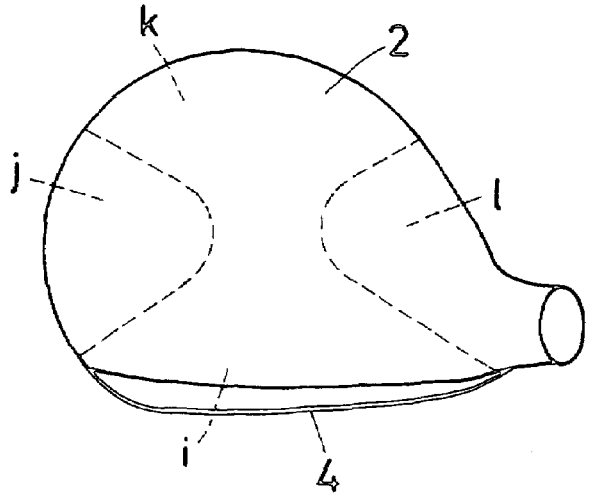
FIG. 9 is a plan view showing other form of a configuration in which different types of metals having different rigidity or strength are integrated in a cross-line form along the face portion to the back portion, and are welded.

For example, in the embodiment of the crown 2 shown in the figure, the i member and the k member are divided in a cross-line form, and the i member is disposed on the face portion side, whereas the k member is disposed on the back portion side. However, as shown in FIG. 9, the i member and the k member may lie having a predetermined with therebetween. Further, the j member and the l member also lie in the same manner, although not shown in the figure. This configuration is same for the sole portion 6.

By taking such configurations, a combination of the member having high rigidity or strength and the member having relatively low rigidity or strength exists in the same part as described above. As a result, it is possible to obtain a golf club having rigidity or the like and a unique quality and form which can be elastically deformed accordingly, when striking a ball. In the present embodiment, the explanation is provided in which, of the different types of metals, the metal plate having high rigidity or strength formed of a titan alloy, and other metal plates are formed of pure titan; however, it goes without saying that the metals plates may be formed of a stainless alloy, an aluminum alloy or the like. The metal plates having different rigidity or strength may differ in thickness in each portion. The range of enlargement of the sweet area can be subtly changed by changing the size of the plate thickness.

The present invention is manufactured within a range based on the regulations including the abovementioned criterion of measurement, and is contrived such that tests are conducted and reviewed, and that the sweet area is enlarged or moved downward at least. In the golf club having such configuration, as is cleared in the following embodiments, the conventional sweet area also can be moved downward in the face portion while enlarging the space between the tow portion and heal portion.

Accordingly the sweet area is enlarged. As a result, even when striking a ball at the lower part of the sweet area, the ball traveling distance is not reduced as in the conventional golf club, and the traveling distance can be increased stably. Furthermore, because the sweet area is enlarged, the maximum restitution coefficient can be increased. As a result, an effect can be generated such that the ball traveling distance can be increased without causing decrease in the restitution coefficient compared to the conventional golf club, even when the ball is struck at the striking surface of the lower part of the face portion.

Embodiment 1

Embodiments which confirm the effects related to the above embodiments are now described. FIG. 10 shows a crown portion (b) and the sole portion (a), and is an embodiment showing a strike result of the golf club which has a configuration where metal plates having different rigidity or strength are integrated and welded in a straight-line form along the back portion from the face portion. As shown in the figure, the thicknesses of the crown portion and the sole portion are different. Conventional examples are also provided for comparison.

In the embodiment 1, the plate thickness of the basic configuration is formed to be equal in order to take the comparison data when compared with the conventional example. However, in the member according to the present invention, the thickness of this member is partially changed. For example, the pure titan parts are made thick in B and D of the sole portion. In the conventional example, A and C are examples in which the metal plate of A is entirely made of pure titan, while that of C is made of a titan alloy. B and D are examples of the embodiment according to the present invention in which a plurality o metals having different rigidity or strength are combined. In the case of B, β titan alloy 15-3-3-3 having high rigidity or strength is disposed on the face portion side through the toe portion and heal portion, pure titan is disposed in three sections in a straight-line form on the back portion side.

In the case of D, the metal part of the central portion of the three divided parts shown in B is a titan alloy. A through D is the order of values of the maximum restitution coefficient. The figure shows S as a repulsion area in which a restitution coefficient is 0.840 or above with respect to the maximum restitution coefficient of 0.870. According to this, S in any of B and D shows large values compared to the conventional example of A and C.

FIG. 11 through FIG. 14 show a data figure showing a specific strike test result. The figures show the center of gravity of the face portion as the center, and the range of the repulsion area as S. In the figures, the vertical axis shows a vertical direction of the face portion, wherein the lower side of the figures is the sole portion and the upper side is the crown portion. The horizontal axis shows a horizontal direction of the face portion, i.e. the direction of the toe portion and of the heal portion, wherein the left side of the figure is the toe portion and the right side is the heal portion.

Figure 12:
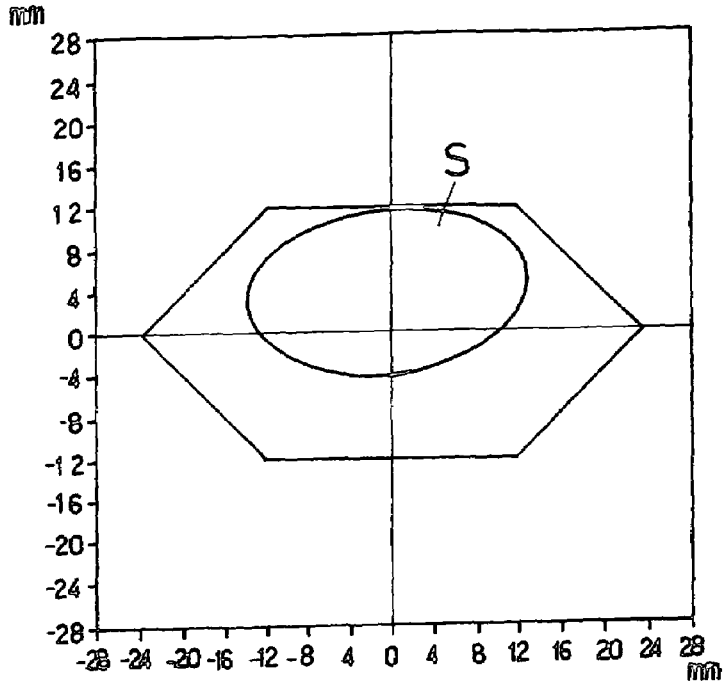
FIG. 12 is a figure showing data in the case of A in the embodiment 1.
Figure 13:
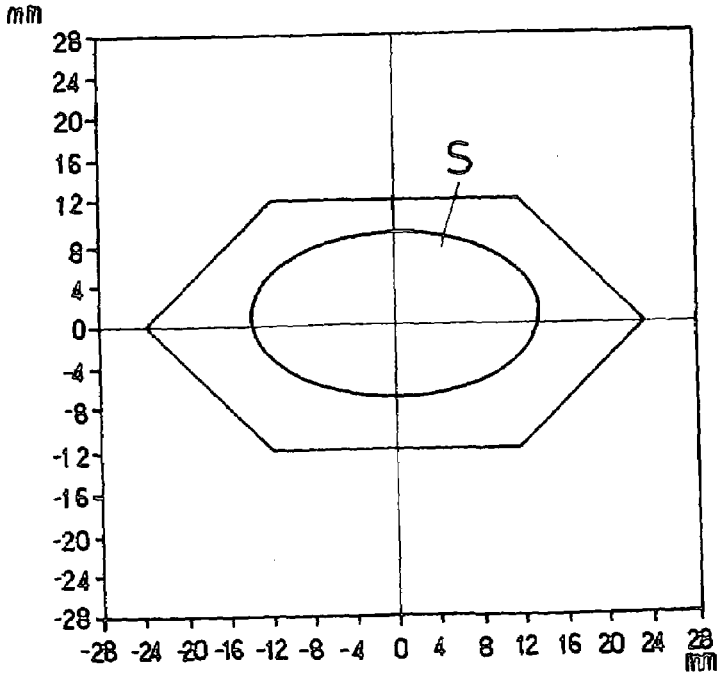
FIG. 13 is a figure showing data in the case of B in the embodiment 1.
Figure 14:
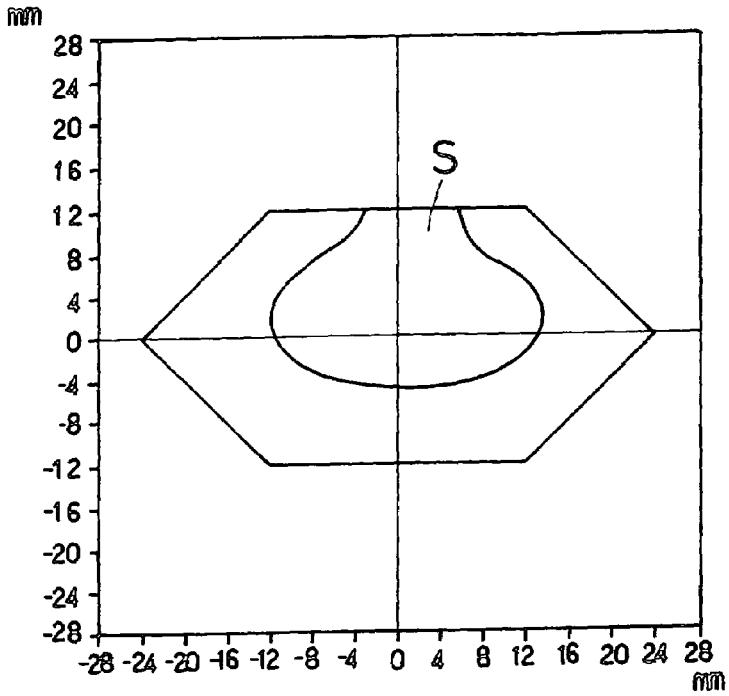
FIG. 14 is a figure showing data in the case of C in the embodiment 1.
Figure 15:
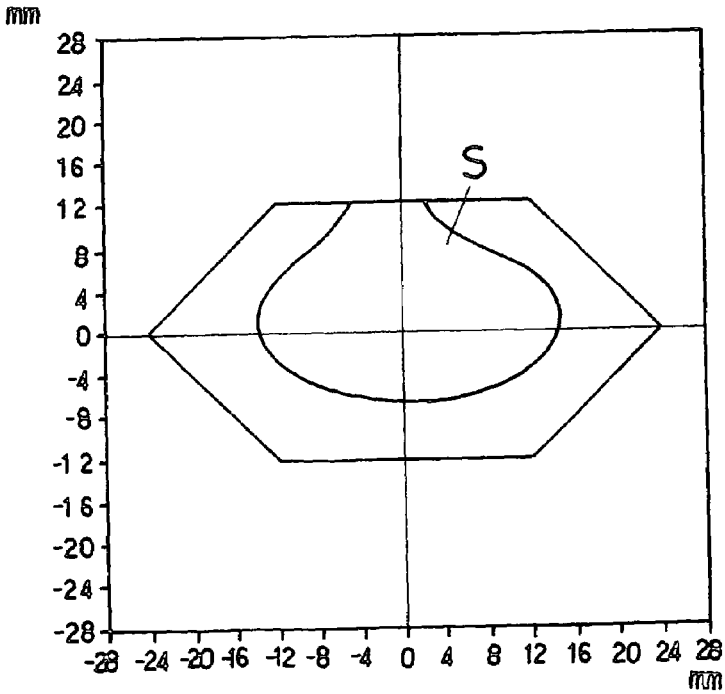
FIG. 15 is a figure showing data in the case of D in the embodiment 1.

FIG. 11 shows the case of A, FIG. 12 shows the case of B, FIG. 13 shows the case of C, and the FIG. 14 shows the case of D. The value of the dimension of each figures is as shown in FIG. 10. As is clear from the data figure the repulsion area shows the spread in not only the horizontal direction but also in the downward direction of the face portion. The effect of the present invention is confirmed through this result.

Embodiment 2

FIG. 11 shows the crown portion (b) and sole portion (a) as in FIG. 10, and is an embodiment showing a configuration in which metal plates having different rigidity or strength are integrated and welded in a cross-line form along the back portion from the face portion, with substantially the center of the crown portion or sole portion as the center. As shown in the figure, the thicknesses of the crown portion and sole portion are different. E, F, and G are embodiments to all of which the configuration of the present invention is applied.

A titan alloy is disposed on the face portion side for E, F and G. All three portions other than the face portion in E is formed of pure titan. A titan alloy is disposed on the back portion side in F, and pure titan is disposed on the tow portion side and on the heal portion side. For G, the sole portion thereof is the same as that of F, and a titan alloy is disposed on the heal portion side of the crown portion.

E through G is the order of values of the maximum restitution coefficient. The figure shows S as a repulsion area in which a restitution coefficient is 0.840 or above with respect to the maximum restitution coefficient of 0.870. According to this, S in any of E, F and G shows large values compared to the values of the conventional example of A and C. It should be noted that the strike test are performed for E, F and G in the same manner as in the embodiment 1, but the value of the dimension is shown in FIG. 10, and the same as that in the abovementioned data figure, thus representation of a data figure for the embodiment 2 is omitted. The effect of the present invention is confirmed through this result.

What is claimed is:

1. A golf club, comprising:

a face portion disposed at a metallic hollow golf club head and having a striking surface for striking a golf ball; and a body portion constituting a remaining part thereof, the body portion comprising:

a sole portion forming a lower portion of the metallic hollow golf club head;

a crown portion forming an upper portion of the metallic hollow golf club head;

a toe portion forming a forepart of the metallic hollow golf club head;

a heel portion forming a rear part of the metallic hollow golf club head;

a back portion positioned opposite the face portion and forming a back part of the metallic hollow golf club head; and a hosel portion to which a shaft is connected, wherein at least one portion of the above portions in the body portion is formed by joining a plurality of different types of metals having different rigidity or strength on the face portion;

wherein the metals are formed into a plurality of metal plates, and the joining is performed by welding;

wherein in the crown portion or the sole portion, the plurality of metal plates comprises a first metal plate disposed within a predetermined width from the face portion to the back portion in substantially the center between the toe portion and the heel portion, a second metal plate disposed on the toe portion side and a third metal plate disposed on the heel portion side.

2. The golf club according to claim 1, wherein the body portion is obtained by welding a sole member having one of the toe portion, the heel portion, and the back portion; a crown member having one of the toe portion, the heel portion, and the back portion; and a hosel member.

3. The golf club according to claim 2, wherein the metal plates having different rigidity or strength are welded by combining with a metal plate having a different size of plate thickness.

4. The golf club according to claim 1, wherein the face portion is constituted by a fourth metal plate having high rigidity or strength.

5. The golf club according to claim 4, wherein the metal plates having high rigidity or strength are made of a titanium alloy, and the other metal plates are made of pure titanium.

6. The golf club according to any of claims 1 or 4, wherein the metal plates having different rigidity or strength are welded by combining with a metal plate having a different size of plate thickness.

* * * * *